United States Patent [19]

Huber et al.

[11] 4,384,577

[45] May 24, 1983

[54] DISPOSABLE FACE MASK

[75] Inventors: Otto L. Huber, Beverly Hills; Mark Magidson, Los Angeles, both of Calif.

[73] Assignee: Moldex/Metric Products, Inc., Culver City, Calif.

[21] Appl. No.: 250,645

[22] Filed: Apr. 3, 1981

[51] Int. Cl.[3] ..... A62B 7/10

[52] U.S. Cl. ..... 128/206.19; 128/206.24

[58] Field of Search ..... 128/206.19, 139, 206.24

[56] References Cited

U.S. PATENT DOCUMENTS

| | | | |
|---|---|---|---|
| 3,220,409 | 11/1965 | Liloia et al. | 128/206.19 |
| 4,037,593 | 7/1977 | Tate, Jr. | 128/139 |
| 4,319,567 | 3/1982 | Magidson | 128/206.19 |

FOREIGN PATENT DOCUMENTS

| | | | |
|---|---|---|---|
| 438863 | 11/1935 | United Kingdom | 128/206.19 |

*Primary Examiner*—Henry J. Recla

*Attorney, Agent, or Firm*—Charles H. Schwartz; Ellsworth R. Roston

[57] ABSTRACT

A face mask for filtering air to a wearer including a plurality of non-woven fibers molded in a generally cup shaped configuration for fitting over the mouth and nose of the wearer and with the cup shaped configuration including a nose bridge portion for lying along the bridge of the nose of the wearer, nose pad portions aligned to either side of the nose bridge portion for fitting against the sides of the nose and a central portion lying below the nose bridge and nose pad portions and with the fibers of the nose pad portions more lightly compacted during molding than the fibers of at least portions of the central portion for providing sealing of the face mask along the sides of the nose and the cheekbones of the wearer, and an elongated ridge member extending across the nose bridge portion and along the nose pad portions and with the elongated ridge more tightly compacted than the nose pad portions to produce a springing action to push the nose pad portions against the side of the nose and the cheekbones of the wearer.

9 Claims, 7 Drawing Figures

14
12
10
15
26
26
28
28
24
22

22
12
10
24
15
14
16
26
26
28
28
20

14
12
18
18
15
12
26
28
26
28
24
22

DISPOSABLE FACE MASK

BACKGROUND OF THE INVENTION

1. Field of the Invention

The present invention is directed to a face mask and as an example to a face mask which may be manufactured inexpensively and therefore may be disposable. Specifically, the present invention is directed to a molded face mask which has a particular physical configuration for providing for a better seal between portions of the face mask to prevent air from passing between portions of the face mask and the face of the wearer. The present invention is an improvement on an earlier filed application Ser. No. 166,315 filed July 17, 1980 and assigned to the same assignee as the instant application. The present invention specifically includes an improved physical structure in the nose bridge area to insure a seal between the face mask and the face of the wearer.

The face mask of the present invention may be used in a variety of different applications. For example, such face masks may be sterilized and then used as surgical masks and with the masks discarded after a single use. Other uses of the face mask of the present invention may be for various industrial applications so as to filter out particles of dust or dirt. In such industrial environments the mask may be used more than once and then discarded when the mask no longer provides for adequate filtering.

2. Description of the Prior Art

In the prior art, disposable face masks have been used and with such masks molded from a sheet or bat of fibers by placing the fiber sheet or bat between dies and with the application of heat and pressure provided for molding the mask to a desired configuration. Reference is made, for example, to U.S. Pat. No. 3,220,409 issued Nov. 30, 1965 and listing Liloia and Bird and the inventors and which patent describes a prior art type of molded face mask.

During the molding of the face mask described in patent 3,220,409, portions of the mask are tightly compacted or compressed relative to other portions of the mask. Specifically in the above-referenced patent the fibers are tightly compacted or compressed in the nose area and along the valleys of flutes in the mask and in a rim area. The use of these tightly compacted areas provides for a mask which has substantial structural strength so as to maintain the molded shape.

SUMMARY OF THE INVENTION

With the face mask described in the above-referenced Ser. No. 166,315, portions of the mask have the fibers more lightly compacted relative to other portions of the mask. However, the portions of the mask which are lightly compacted are substantially opposite to the lightly compacted portions referred to in the above-referenced patent No. 3,220,409. In addition, with the present invention the nose bridge portion of the mask includes a tightly compacted elongated ridge which extends across the bridge of the nose and down along the sides of the nose and into the cheekbone area.

The specific structure of the elongated ridge of the present invention provides for a springing action so that the nose bridge and cheekbone portion of the face mask are held in firm engagement against the face of the wearer. This in combination with lightly compacted nose pad portions of the mask in areas corresponding to the sides of the nose and along the cheekbone provide for a tight seal to prevent the leakage of air. This is because the lightly compacted nose pad portions are softer and also thicker than other portions of the face mask and the lightly compacted nose pad portions tend to lie against the side of the nose and against the cheekbones and provide for a good edge seal. The tightly compacted elongated ridge extends across the bridge of the nose and along the nose pad portions and acts as a spring to maintain the lightly compacted nose pad portions against the side of the nose and against the cheekbone. It should be appreciated that the particular areas which are maintained in a sealed relationship are important since with prior art face masks exhaled air would tend to leak out of the face mask around the sides of the nose and over the cheekbones and up towards the eyes.

In the prior art if the wearer of the face mask also wore eyeglasses such as safety glasses, then leaked air along the sides of the nose and cheekbone would tend to fog up the eyeglasses. With the face mask of the present invention the elongated ridge not only helps to maintain a better seal along the sides of the nose and across the cheekbones but also the specific design for this ridge portion provides for a support area to receive the bottom edge of the eyeglasses. The eyeglasses, therefore, tend to lie just forward of the elongated ridge and thereby additionally help to provide for a better seal along the sides of the nose and across the cheekbones. The present invention therefore provides for an improved sealing of the face mask against the wearer's face to prevent the leakage of air and thereby provide for a more efficient, reliable face mask.

BRIEF DESCRIPTION OF THE DRAWINGS

A clearer understanding of the invention will be had with reference to the following description and drawings wherein.

DESCRIPTION OF THE PREFERRED EMBODIMENT

In the Figures, a face mask 10 constructed in accordance with the teachings of the present invention is shown to have the face mask molded to a generally cup shape configuration. The face mask 10 includes a nose bridge portion 12 structured to fit over the bridge of the nose of the wearer. The nose bridge is molded to include an elongated ridge 14 extending across the nose bridge and down along the sides of the face mask adjacent the cheekbones of a wearer of the face mask.

The elongated ridge 14 provides stiffening along the upper edge of the nose bridge portion 12 so as to act as a spring member to produce a shape retention for the face mask and to operate to have the sides of the bridge portion 12 being pushed inwardly so as to push the bridge portion against the nose and the cheekbones of the wearer. The bridge portion 12 may also include additional ridges such as a ridge 15 to provide additional shape retention for the bridge portion 12.

Figure 1:
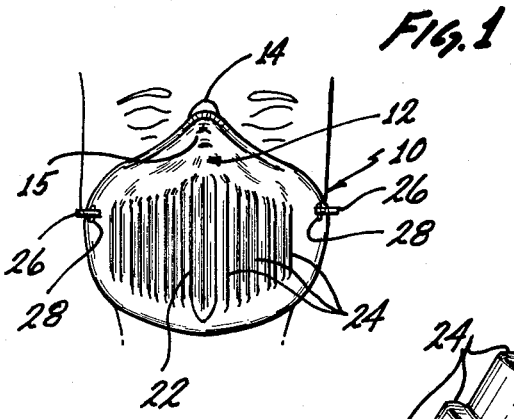
FIG. 1 illustrates a front view of the face mask of the present invention showing the mask in position against the face of the wearer.
Figure 2:
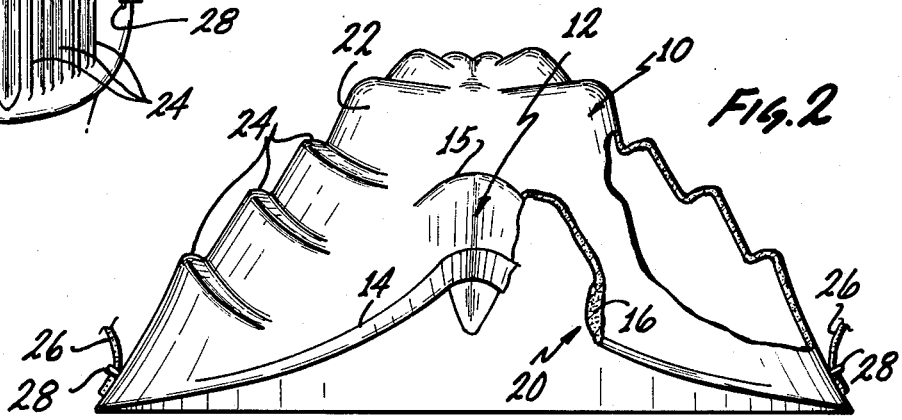
FIG. 2 is a top view partially broken away of a face mask of the present invention.
Figure 3:
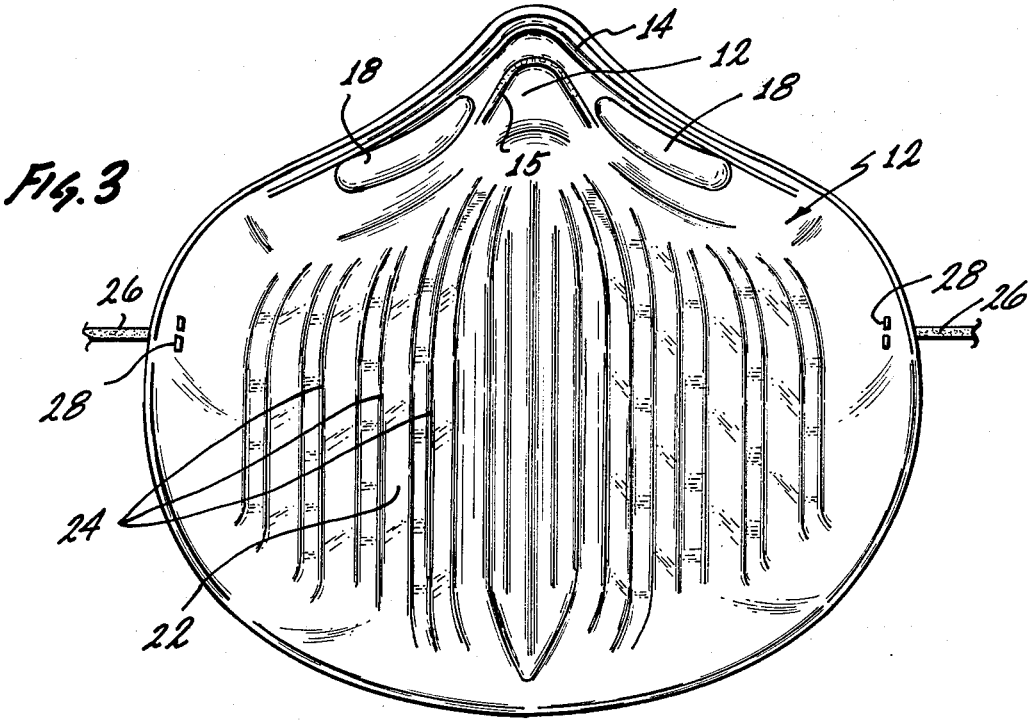
FIG. 3 is an enlarged back view of the face mask of the present invention.

Extending on either side of the nose bridge portion 12 are lightly compacted nose pad portions 16 and 18. As shown in partially broken away section 20, shown in FIG. 2, the nose pad portions 16 and 18 are thicker than adjacent portions of the face mask. The thicker, more lightly compacted nose pad portion 16 and 18 are more flexible and more resilient than the adjacent portions and tend to lie against the sides of the nose and the cheekbone to provide for an efficient seal against the face. The elongated ridge 14 acts as a resilient spring so as to maintain the edge of the face mask and also the nose pad portion 16 and 18 against the nose and cheekbones of the face of the wearer even with movement of the face. For example, during talking, movement of the face would allow for the escape of air unless the edge of the face mask 10 and the nose pad portions 16 and 18 are resiliently maintained against the face.

Below the bridge portion 12 is a central portion 22 of the face mask. The central portion 22 of the face mask 10 includes a plurality of substantially parallel ridges 24 which are formed during the molding of the mask and provide for a stiffening of the central portion 22 of the mask to produce a desired shape retention for the mask. In general, the entire central portion 22 of the mask including both the peaks and valleys of the ridges 24 are compacted to substantially the same degree. Also the central portion 22 may be compacted to substantially the same degree as the nose bridge portion 12 including the elongated ridge 14. Alternatively, the elongated ridge 14 may be compacted to a greater degree than any other portion of the face mask 10 so as to provide for the maximum degree of spring action across the nose bridge of the face mask. Moreover, as can be seen most clearly in FIGS. 4 and 5, the elongated ridge 14 may be compacted to have a sharper angular relationship resembling a Z cross-section to thereby increase the stiffening effect and thereby increase the spring action provided by the elongated ridge 14.

Although the central portion 22 of the face mask 10 is more tightly compacted than the nose pad portion 16 and 18, the central portion 22 is not so tightly compacted so as to restrict a relatively free passage of air. In this way the breathing of the wearer of the mask is not adversely affected. The mask may actually be held onto the face of the wearer using an elastic band 26 attached to the mask by staples 28.

Figure 4:
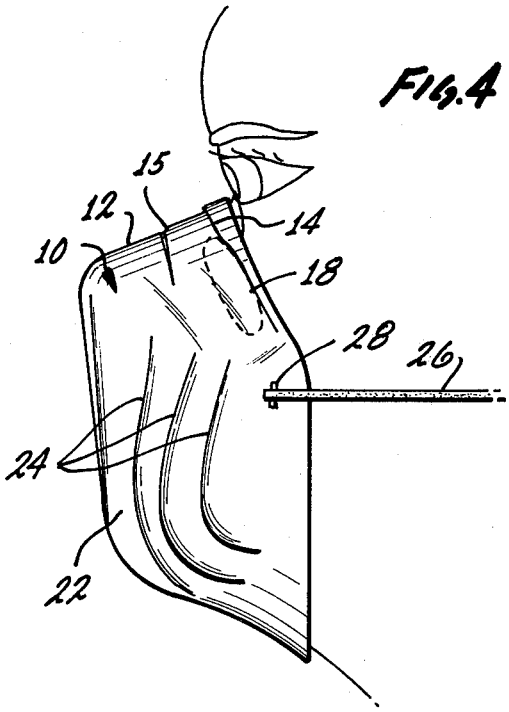
FIG. 4 is a side view of the face mask of the present invention showing the mask in position against the face of the wearer.
Figure 5:
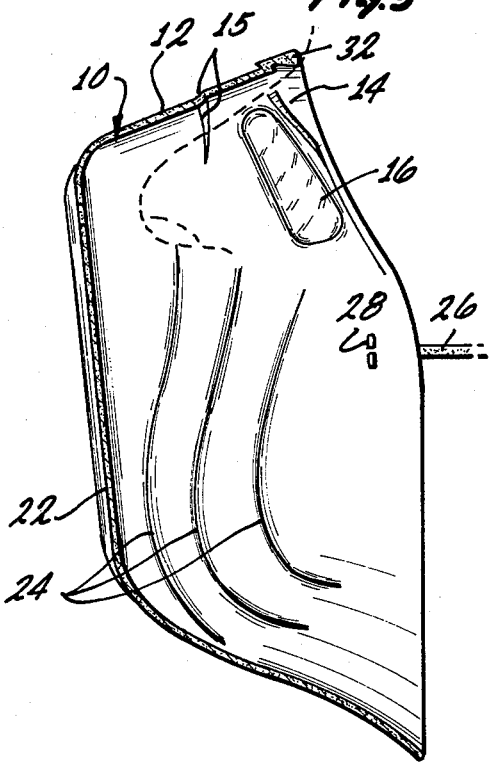
FIG. 5 is a side cross sectional view of the face mask showing the mask in position against the face of the wearer.

As can be seen in FIGS. 4 and 5 and also with reference to earlier filed application Ser. No. 166,315, the peripheral edge portion of the mask 10 lies against the face of the wearer extending on both sides from an upper position adjacent the bridge of the nose to a lower position under the chin. The use of the lightly compacted nose pad portion 16 and 18 provide for these more resilient and thicker portions conforming to the sides of the nose and the cheekbones. Again, as seen with reference to FIGS. 4 and 5, the nose pad portions provide for a seal to restrict the passage of air through the portions 16 and 18. The nose pad portions 16 and 18 therefore exclude air, which is exhaled from the wearer from escaping from the sides of the nose and around the cheekbone. The escaping air can be uncomfortable to a wearer of the face mask and can fog eyeglasses. The elongated ridge 14 provides for a spring pressure in the upper portion of the face mask 10 over the nose bridge portion 12 to maintain the nose pads in their proper position during movement of the face. This insures that the face mask fits tightly against the face of the wearer to prevent the escaping of air.

Figure 6:
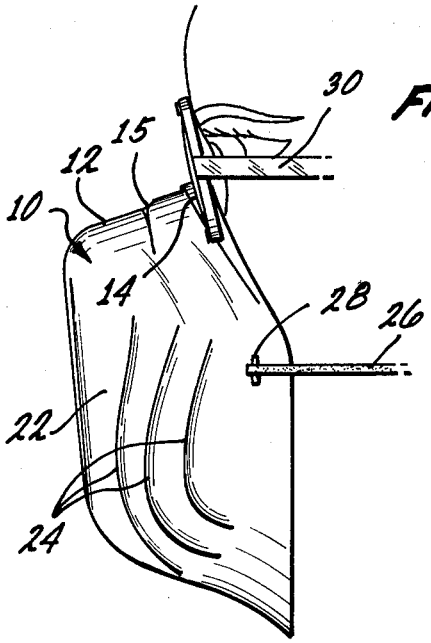
FIG. 6 is a side view of the face mask in position against the face of a wearer wearing eyeglasses.
Figure 7:
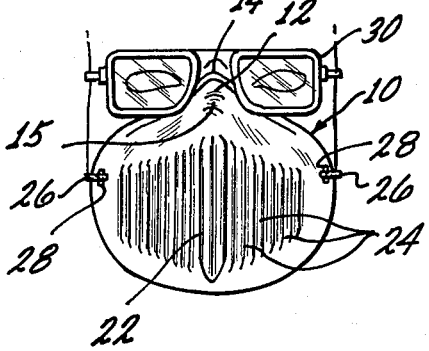
FIG. 7 is a front view of the face mask showing the mask in position against the face of the wearer wearing eyeglasses.

As shown in FIGS. 6 and 7 the elongated ridge 14 is specifically designed to capture the bottom edge of eyeglass frame 30 which may be worn by the wearer of the mask. In many industrial applications safety glasses are used so that almost everyone using a face mask would also be wearing some form of eyeglasses. The bottom edge of the eyeglass frame and specifically the portions of the frame 30 adjacent the sides of the nose and the cheekbones lie against the mask just forward of the elongated ridge 14. The forward portion of the elongated ridge therefore serves to receive and support the bottom edge of the eyeglasses and thereby tends to lock the face mask in proper sealing position. The face mask of the present invention therefore additionally allows for the wearer of the face mask to comfortably wear eyeglasses and with the eyeglasses actually serving to provide for an additional sealing of the face mask in position against the face of the wearer.

Although the present application has been described with reference to particular embodiments, it is to be appreciated that other adaptations and modifications may be made. For example, the edge portion of the face mask and in particular the edge portion around the nose may also be compacted to a lesser degree than the remaining portions of the face mask except for the nose pads 16 and 18. This may be seen for example with reference to the edge portion 32 shown in FIG. 5. This can provide for additional sealing across the bridge of the nose and down the sides of the nose. Alternatively, the entire edge portion of the face mask extending completely around the mask may be more lightly compacted.

Also, it is to be appreciated that the face mask 10 may be formed by placing a sheet or bat of non-woven fiber material having a substantial uniform thickness between die members and with the die members brought towards each other while at the same time heating the die members so as to form the unitary face mask by compression and heat. It is to be appreciated that various materials may be used such as polyester materials and the invention is not to be limited to any specific type of material. The invention is therefore only to be limited by the appended claims.

We claim:

1. A face mask formed by a plurality of fibers and generally having a cup shape to fit over the mouth and nose of the wearer and for filtering the air passing through the fibers including:

a nose bridge portion, nose pad portions to either side of the nose bridge portion to fit against the sides of the nose and against the cheekbone of the wearer, and an elongated ridge extending along and spaced from an edge of the face mask within the nose bridge portion and to either side of the nose bridge portion and along the nose pad portions and with the elongated ridge located between the edge of the face mask and the nose pad portions for providing a spring action to have the nose pad portions forced against the side of the nose and against the cheekbones of the wearer for preventing the passage of air between the mask and the face of the wearer.

2. The face mask of claim 1 wherein the mask includes a central portion below the nose bridge portion and the nose pad portions and with the fibers of the nose pad portions more lightly compacted than the fibers in at least the central portion of the face mask to have the nose pad portions thicker and more flexible than at least the central portion of the face mask and with the elongated ridge more tightly compacted than the nose pad portions.

3. The face mask of claim 1 wherein the nose bridge portion includes one additional ridge extending across the nose bridge portion for providing additional shape retention for the face mask.

4. The face mask of claim 1 and with the face mask including a central portion of the face mask below the nose bridge portion and the nose pad portions and with the central portion of the face mask including ridges extending along the central portion for providing shape retention for the face mask.

5. The face mask of claim 1 additional including a peripheral edge pad portion extending around the periphery of the face mask in at least the nose bridge portion and with the fibers of the peripheral edge pad portion more lightly compacted than the fibers in the elongated ridge to have the peripheral edge portion thicker and more flexible than at least the elongated ridge providing a seal around the peripheral edge to prevent the passage of air between the mask and the face of the wearer.

6. A face mask for filtering air to a wearer including, a plurality of non-woven fibers molded in a generally cup shaped configuration for fitting over the mouth and nose of the wearer and with the cup shaped configuration including, a nose bridge portion for lying along the bridge of the nose of the wearer, nose pad portions aligned to either side of the nose bridge portion for fitting against the sides of the nose and cheekbones of the wearer, a central portion lying below the nose bridge and nose pad portions and with the fibers of the nose pad portions more lightly compacted during molding than the fibers of at least portions of the central portion for providing sealing of the face mask along the sides of the nose and the cheekbones of the wearer, and an elongated ridge member spaced from an edge of the face mask and extending across the nose bridge portion and along the nose pad portions and with the elongated ridge located between the edge of the face mask and the nose pad portions and with the elongated ridge more tightly compacted than the nose pad portions to produce a springing action to push the nose pad portions against the side of the nose and the cheekbones of the wearer.

7. The face mask of claim 6 wherein the nose bridge portion includes at least one additional ridge extending across the nose bridge portion for providing shape retention for the nose bridge portion of the face mask.

8. The face mask of claim 6 wherein the central portion of the face mask includes ridges extending along the central portion for providing shape retention for the central portion of the face mask.

9. The face mask of claim 6 additionally including a peripheral edge pad portion extending along at least the periphery of the nose bridge portion and with the molded fibers of the peripheral edge pad portion more lightly compacted than the fibers in the elongated ridge member for providing sealing around the peripheral edge of the face mask.

* * * * *